United States Patent [19]

Schmid

[11] 4,222,846

[45] Sep. 16, 1980

[54] COAL LIQUEFACTION-GASIFICATION PROCESS INCLUDING REFORMING OF NAPHTHA PRODUCT

[75] Inventor: Bruce K. Schmid, Denver, Colo.

[73] Assignee: Gulf Oil Corporation, Pittsburgh, Pa.

[21] Appl. No.: 969,280

[22] Filed: Dec. 13, 1978

[51] Int. Cl.[2] ..... C10G 1/00; C10G 1/08; C10J 1/00; C10J 3/00

[52] U.S. Cl. ..... 208/8 LE; 208/10; 48/197 R; 48/210

[58] Field of Search ..... 208/8 LE, 10; 48/197 R, 48/210

[56] References Cited

U.S. PATENT DOCUMENTS

| | | | |
|---|---|---|---|
| 3,071,536 | 1/1963 | Stiles et al. | 208/60 |
| 3,518,182 | 6/1970 | Paterson | 208/50 |
| 3,700,586 | 10/1972 | Schulman | 208/89 |
| 4,039,424 | 8/1977 | Hyde et al. | 208/8 LE |
| 4,075,079 | 2/1978 | Lang | 208/8 LE |

OTHER PUBLICATIONS

Feedstocks from Coal: How? When? O'Hara et al., pp. 117–121, Petrochemical Developments, Hydrocarbon Processing, Nov. 1978.

*Primary Examiner*—Delbert E. Gantz
*Assistant Examiner*—William G. Wright

[57] ABSTRACT

A combination coal liquefaction-gasification-naphtha reforming process wherein the slurry containing substantially the entire yield of normally solid dissolved coal produced in the liquefaction zone comprises substantially the only hydrocarbonaceous feed for the gasification zone and wherein a portion of the naphtha produced in the liquefaction zone is passed through the reforming zone for conversion to gasoline with the remainder of the naphtha being burned as fuel within the process. The amount of hydrocarbonaceous material charged to the gasification zone is established so that the thermal efficiency of the process is substantially unaffected by changes in the ratio of naphtha passed through the reforming zone to naphtha burned as process fuel. The thermal efficiency of the process is maintained at a high level regardless of minor variations in normally solid dissolved coal yield by changing the ratio of naphtha passed through the reforming zone to naphtha burned as process fuel.

12 Claims, 3 Drawing Figures

FIGURE 1

COAL LIQUEFACTION-GASIFICATION PROCESS INCLUDING REFORMING OF NAPHTHA PRODUCT

This invention relates to a process wherein coal liquefaction and oxidation gasification operations are combined with a step for reforming the naphtha produced in the liquefaction operation. A thermal efficiency advantage is achieved by utilizing syngas from the gasification zone as fuel in the reforming zone and/or elsewhere in the process and recovering hydrogen from the reforming operation for process use. This system contributes to the thermal efficiency of the process by reducing the amount of syngas that must be directly upgraded to process hydrogen.

The liquefaction zone of the present process comprises an endothermic preheating step and an exothermic dissolving step. The temperature in the dissolver is higher than the maximum preheater temperature because of the hydrogenation and hydrocracking reactions occurring in the dissolver. Residue slurry from the dissolver or from any other place in the process containing liquid solvent and normally solid dissolved coal and suspended mineral residue is recirculated through the preheater and dissolver steps. Gaseous hydrocarbons and liquid hydrocarbonaceous distillate are recovered from the liquefaction zone product separation system. The portion of the dilute mineral-containing residue slurry from the dissolver which is not recycled is passed to atmospheric and vacuum distillation towers. All normally liquid and gaseous materials are removed overhead in the towers and are therefore substantially mineral-free while concentrated mineral-containing residue slurry is recovered as vacuum tower bottoms (VTB).

Normally liquid coal is referred to herein by the terms "distillate liquid" and "liquid coal", both terms indicating dissolved coal which is normally liquid at room temperature, including a naphtha fraction and liquid boiling above the naphtha range, such as process solvent. The concentrated slurry contains all of the inorganic mineral matter and all of the undissolved organic material (UOM), which together is referred to herein as "mineral residue". The amount of UOM will always be less than 10 or 15 weight percent of the feed coal. The concentrated slurry also contains the 850° F.+(454° C.+) dissolved coal, which is normally solid at room temperature, and which is referred to herein as "normally solid dissolved coal". This slurry is passed in its entirety without any filtration or other solidsliquid separation step and without a coking or other step to destroy the slurry, to a partial oxidation gasification zone adapted to receive a slurry feed, for conversion to synthesis gas, which is a mixture of carbon monoxide and hydrogen. The slurry is the only carbonaceous feed supplied to the gasification zone. An oxygen plant is provided to remove nitrogen from the oxygen supplied to the gasifier so that the synthesis gas produced is essentially nitrogen-free.

A portion of the synthesis gas is subjected to the shift reaction to convert it to hydrogen and carbon dioxide. The carbon dioxide, together with hydrogen sulfide, is then removed in an acid gas removal system. The entire hydrogen-rich stream so produced is utilized in the process. More synthesis gas is produced than is converted to a hydrogen-rich stream. Most or all of this excess portion of the synthesis gas is burned as fuel within the process so that its heat content is recovered via combustion. Synthesis gas which is burned as fuel within the process is not subjected to a methanation step or to any other hydrogen-consuming reaction, such as the production of methanol, prior to combustion within the process. Any of the excess synthesis gas which cannot be utilized as fuel within the process will be subjected to a methanation step or to a methanol conversion step. Methanation is a process commonly employed to increase the heating value of synthesis gas by converting carbon monoxide to methane. In accordance with this invention, the quantity of hydrocarbonaceous material entering the gasifier in the VTB slurry is controlled at a level not only adequate to produce by partial oxidation and shift conversion reactions the entire hydrogen requirement for the process except for the hydrogen produced in the reforming zone, but also sufficient to produce synthesis gas or a CO fraction thereof whose total combustion heating value without hydrogenative upgrading is adequate to supply on a heat basis at least 5 or 10 and preferably at least 50, 70 or 80 percent of the total energy required for the process, such energy being in the form of fuel for the preheater, fuel for the naphtha hydropretreater, steam for pumps, inplant generated or purchased electrical power, etc.

The severity of the hydrogenation and hydrocracking reactions occurring in the dissolver step of the liquefaction zone is varied in accordance with this invention to regulate the combination process on a thermal efficiency basis. The severity of the dissolver step is established by the temperature, hydrogen pressure, residence time and mineral residue recycle rate. Optimization of the process on a thermal efficiency basis requires process flexibility so that the output of the gasifier will supply not onlythe entire process hydrogen requirement not satisfied by the hydrogen yield from the reformer but also a significant portion of the energy requirement of the process. It is important to optimization of process thermal efficiency that substantially all of the excess syngas beyond the amount required to produce process hydrogen is burned as fuel in the process without methanation or other hydrogenative conversion since hydrogenative conversion consumes energy and reduces thermal efficiency.

The VTB in its entirety is passed to the gasification zone. Because the VTB contains all of the mineral residue of the process in slurry with all normally solid dissolved coal produced in the process, no step for the separation of mineral residue from dissolved coal, such as filtration, settling, gravity solvent-assisted settling, solvent extraction of hydrogen-rich compounds from hydrogen-lean compounds containing mineral residue, centrifugation or similar step is required. Also, no mineral residue drying, normally solid dissolved coal cooling and handling steps, or delayed or fluid coking steps are required in the combination process. Elimination or avoidance of each of these steps considerably improves the thermal efficiency of the process.

Recycle of a portion of the mineral residue-containing slurry through the liquefaction zone increases the concentration of mineral residue in the preheater and dissolver steps. Since the inorganic mineral matter in the mineral residue is a catalyst for the depolymerization and free radical hydrogenation reactions occurring in the preheater zone and for the hydrogenation and hydrocracking reactions occurring in the dissolver zone and is also a catalyst for the conversion of sulfur to hydrogen sulfide and for the conversion of oxygen to water, dissolver size and residence time is diminished due to mineral recycle, thereby making possible the high efficiency of the present process. Recycle of mineral residue of itself can advantageously reduce the yield of normally solid dissolved coal by as much as about one-half, thereby increasing the yield of more valuable liquid and hydrocarbon gaseous products and reducing the feed to the gasifier zone. Because of mineral recycle, the process is rendered autocatalytic and no external catalyst is required, further tending to enhance the process efficiency. It is a particular feature of this invention that recycle solvent does not require hydrogenation in the presence of an external catalyst to rejuvenate its hydrogen donor capabilities.

The coal feed to the process can comprise bituminous or subbituminous coals or lignites. All of the raw feed coal supplied to the combination process is supplied to the liquefaction zone, and none is supplied directly to the gasification zone. The mineral residue-containing VTB slurry comprises the entire hydrocarbonaceous feed to the gasifier zone. A liquefaction process can operate at a higher thermal efficiency than a gasification process at moderate yields of solid dissolved coal product. Part of the reason that a gasification process has a lower efficiency is that a partial oxidation gasification process produces synthesis gas (CO and $H_2$) and requires either a subsequent shift reaction step to convert the carbon monoxide with added steam to hydrogen, if hydrogen is to be the ultimate gaseous product, or a subsequent shift reaction and methanation step, if pipeline gas is to be the ultimate gaseous product. In either case, a byproduct of the subsequent step is carbon dioxide which must be rejected to the atmosphere. Since this represents a loss of some of the carbon content of the feed coal, it represents a decrease in process efficiency. A shift reaction step is required prior to a methanation step to increase the ratio of CO to $H_2$ from about 0.6 to about 3 to prepare the gas for methanation. Passage of the entire raw coal feed through the liquefaction zone allows conversion of some of the coal components to premium products at the higher efficiency of the liquefaction zone prior to passage of non-premium normally solid dissolved coal to the gasification zone for conversion at a lower efficiency.

The utilization of synthesis gas or a carbon monoxide-rich steam as a fuel within the process is important and contributes to the high efficiency of the process. Synthesis gas or a carbon monoxide-rich stream is not marketable as commercial fuel because its carbon monoxide content is toxic, and because it has a lower heating value than methane. However, neither of these objections to the commercial use of synthesis gas or carbon monoxide as a fuel applies in the present process. First, because the plant of the present process already contains a synthesis gas unit, it is equipped with means for protection against the toxicity of carbon monoxide. Such protection would be unlikely to be available in a plant which does not produce synthesis gas. Secondly, because the synthesis gas is employed as fuel at the plant site, it does not require transport to a distant location. The pumping costs of pipeline gas are based on gas volume and not on heat content. Therefore, on a heating value basis the pumping cost for transporting synthesis gas or carbon monoxide would be much higher than for the transport of methane. But because synthesis gas or carbon monoxide is utilized as a fuel at the plant site in accordance with this invention, transport costs are not significant. Since the present process embodies on site utilization of synthesis gas or carbon monoxide as fuel without a methanation or other hydrogenation step, a thermal efficiency improvement is imparted to the process. The thermal efficiency advantage achieved is diminished or lost if an excessive amount of synthesis gas is methanated and utilized as pipeline gas. Also, if synthesis gas is produced by the gasifier in an amount in excess of that required for process hydrogen, and all of the excess synthesis gas is methanated, there is a negative effect upon thermal efficiency in an integrated liquefaction-gasification process.

The thermal efficiency of the present process is enhanced because energy for the process is satisfied by direct combustion of synthesis gas produced in the gasification zone. It is surprising that the thermal efficiency of a liquefaction process can be enhanced by gasification of the normally solid dissolved coal obtained from the liquefaction zone, rather than by further conversion of said coal within the liquefaction zone, since coal gasification is known to be a less efficient method of coal conversion than coal liquefaction. Therefore, it would be expected that putting an additional load upon the gasification zone, by requiring it to produce process energy in addition to process hydrogen, would reduce the efficiency of the combination process. Furthermore, it would be expected that it would be especially inefficient to feed to a gasification a coal that has already been subjected to hydrogenation, as contrasted to raw coal, since the reaction in the gasifier zone is an oxidation reaction. In spite of these observations, it has been unexpectedly found that the thermal efficiency of the present combination process is increased when the gasifier produces a significant amount or most of the process fuel, as well as process hydrogen. The present invention demonstrates that in a combination coal liquefaction-gasification process the shifting of a portion of the process load from the more efficient liquefaction zone to the less efficient gasification zone in the manner and to the extent described can unexpectedly provide a more efficient combination process.

In order to embody the discovered thermal efficiency advantage of the present invention, the combination coal liquefaction-gasification plant must be provided with conduit means for transporting a portion of the synthesis gas produced in the partial oxidation zone to one or more combustion zones within the process provided with means for the combustion of synthesis gas. First, the synthesis gas is passed through an acid gas removal system for the removal of hydrogen sulfide and carbon dioxide therefrom. The removal of hydrogen sulfide is required for environmental reasons, while the removal of carbon dioxide upgrades the heating value of the synthesis gas and permits finer temperature control in a burner utilizing the synthesis gas as a fuel. As stated, to achieve the demonstrated improvement in thermal efficiency, the synthesis gas must be passed to the combustion zone without any intervening synthesis gas methanation or other hydrogenation step.

It is advantageous to employ high gasifier temperatures in the range 2,200° to 3,600° F. (1,204° to 1,982° C.). These high temperatures improve process efficiency to encouraging the gasification of essentially all the carbonaceous feed to the gasifier. These high gasifier temperatures are made possible by proper adjustment and control of rates of injection of steam and oxygen to the gasifier. The steam rate influences the endothermic reaction of steam with carbon to produce CO and $H_2$, while the oxygen rate influences the exothermic reaction of carbon with oxygen to produce CO.

Because of the high temperatures indicated above, the synthesis gas produced according to this invention will have $H_2$ and CO mole ratios below 1, and even below 0.9, 0.8 or 0.7. However, because of the equal heats of combustion of $H_2$ and CO the heat of combustion of the synthesis gas produced will not be lower than that of a synthesis gas having higher ratios of $H_2$ to CO. Thus the high gasifier temperatures of this invention are advantageous in contributing to a higher thermal efficiency by making possible oxidation of nearly all of the carbonaceous material in the gasifier, but the higher temperatures do not introduce a significant disadvantage with respect to the $H_2$ and CO ratio because of the use of much of the synthesis gas as fuel. In processes where all of the synthesis gas undergoes hydrogenative conversion, low ratios of $H_2$ to CO would constitute a considerable disadvantage.

The synthesis gas can be apportioned within the process on the basis of an aliquot or non-aliquot distribution of its $H_2$ and CO content. If the synthesis gas is to be apportioned on a non-aliquot basis, a portion of the synthesis gas can be passed to a cryogenic separator or to an adsorption unit to separate carbon monoxide from hydrogen. A hydrogen-rich stream is recovered and included in the make-up hydrogen stream to the liquefaction zone. A carbon monoxide-rich stream is recovered and blended with full range synthesis gas fuel containing aliquot quantities of $H_2$ and CO, or employed independently as process fuel.

Employment of a cryogenic or adsorption unit, or any other means, to separate hydrogen from carbon monoxide contributes to process efficiency since hydrogen and carbon monoxide exhibit about the same heat of combustion, but hydrogen is more valuable as a reactant than as a fuel. The removal of hydrogen from carbon monoxide is particularly advantageous in a process where adequate carbon monoxide is available to satisfy most of process fuel requirements. It is observed that removal of the hydrogen from the synthesis gas fuel can actually increase the heating value of the remaining carbon monoxide-rich stream. A synthesis gas stream having a heating value of 300 BTU/SCF (2,670 cal. kg/$M^3$) exhibited an enhanced heating value of 321 BTU/SCF (2,857 cal. kg/$M^3$) following removal of its hydrogen content. The capacity of the present process to interchangeably utilize full range synthesis gas or a carbon monoxide-rich stream as process fuel advantageously permits the recovery of the more valuable hydrogen component of synthesis gas without incurring a penalty in terms of degradation of the remaining carbon monoxide-rich stream. Therefore, the remaining carbon monoxide-rich stream can be utilized directly as process fuel without any upgrading step.

DESCRIPTION OF THE DRAWINGS

FIG. 1 was presented in Ser. No. 905,299, filed May 12, 1978, now U.S. Pat. No. 4,159,238 which is hereby incorporated by reference. Curve A of FIG. 1 illustrates the optimization of thermal efficiency in a combination coal liquefaction-gasification process wherein the naphtha produced in the liquefaction zone is recovered as a product of the process without reforming or other upgrading. Curve B of FIG. 1 represents the thermal efficiency of a gasification process alone for the production of hydrogen or pipeline gas. FIG. 1 shows that the thermal efficiency of a combination coal liquefaction-gasification process in which all normally solid dissolved coal produced is passed to the gasification zone is higher than that of a gasification process alone. The superiority is maximized when the liquefaction zone produces an intermediate yield of normally solid dissolved coal, all or which is consumed in the gasification zone. The intermediate yield of normally solid dissolved coal is most easily achieved by employing slurry recycle due to the catalytic effect of minerals in the recycle slurry and due to the opportunity for further reaction of recycled normally solid dissolved coal. The thermal efficiency of the combination process would be lower than that of a gasification process alone if the severity of the liquefaction operation were so low and the amount of solid coal passed to the gasification plant were so high that the plant produced a great deal more hydrogen and gaseous fuel than it could consume, since that would be similar to straight gasification of coal. At the other extreme, if the severity of the liquefaction process were so high and the amount of solid coal passed to the gasification plant so low that the gasifier could not produce even the hydrogen requirement of the process (hydrogen production is the first priority of gasification), the shortage of hydrogen would have to be made up from another and less efficient source, such as steam reforming of hydrocarbon gases produced in the process.

Figure 1:
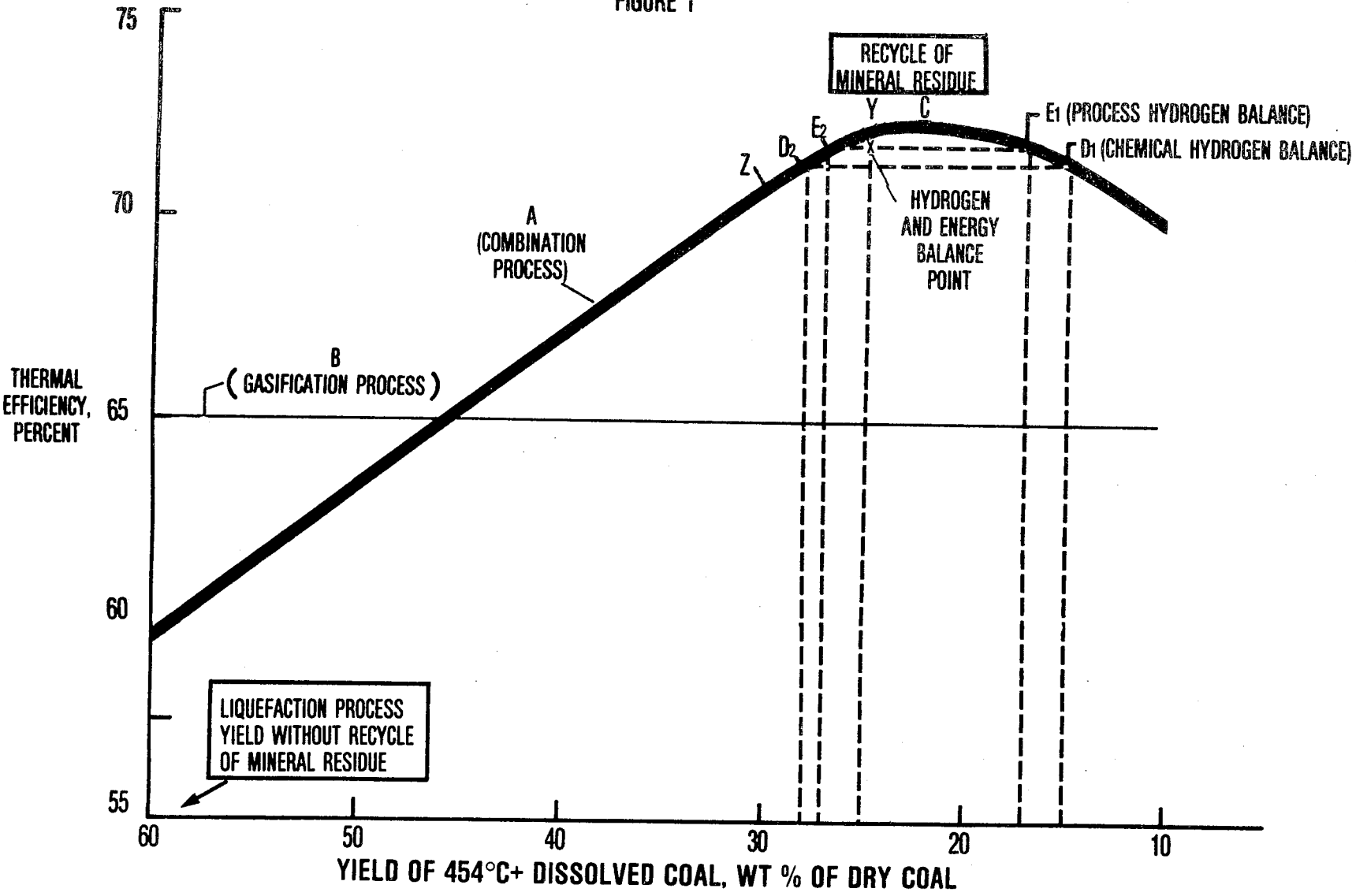
FIG. 1 is a graph of the percent of thermal efficiency verses yield of 454° C. plus dissolved coal, wt. % of dry coal. Both gasification and combination gasification liquefaction processes are disclosed.

Thermal efficiency of any process or combination process described herein is calculated from the input and output energies of the process. The output energy is equal to the high heating value (kilocalories) of all product fuels recovered from the process. The input energy is equal to the high heating value of the feed coal of the process plus the heating value of any fuel supplied to the process from an external source plus the heat required to produce purchased electrical power. Assuming a 34 percent efficiency in the production of electric power, the heat required to produce purchased electric power is the heat equivalent of the electric power purchased divided by 0.34. The high heating value of the feed coal and product fuels of the process are used for calculations. The high heating value assumes that the fuel is dry and that the heat content of the water produced by reaction of hydrogen and oxygen is recovered via condensation. The thermal efficiency can be calculated as follows:

$$\text{Efficiency} = \frac{\text{ENERGY OUTPUT}}{\text{ENERGY INPUT}} = \frac{\text{heat content of all recovered product fuels}}{\left(\text{heat content of feed coal}\right) + \left(\text{heat content of any fuel supplied from outside the process}\right) + \left(\text{heat required to produce purchased electric power}\right)}$$

All of the raw feed coal for the process is pulverized, dried and mixed with hot solvent-containing recycle slurry. The recycle slurry is considerably more dilute than the slurry passed to the gasifier zone because it is not first vacuum distilled and contains a considerable quantity of 380° to 850° F. (193° to 454° C.) distillate liquid, which performs a solvent function. One to four parts, preferably 1.5 to 2.5 parts, on a weight basis, of recycle slurry are employed to one part of raw coal. The recycle slurry, hydrogen and raw coal are passed through a fired tubular preheater zone, and then to a reactor or dissolver zone. The ratio of hydrogen to raw coal is in the range 20,000 to 80,000 and is preferably 30,000 to 60,000 SCF per ton (0.62 to 2.48, and is preferably 0.93 to 1.86 $M^3$/kg).

The temperature of the reactants gradually increases during flow through the tubular preheater so that the preheater outlet temperature is in the range 680° to 820° F. (360° to 438° C.), preferably about 700° to 760° F. (371° to 404° C.). The coal is dissolved at this temperature via deploymerization and free radical hydrogenation reactions and exothermic hydrogenation and hydrocracking reactions are beginning. The heat generated by these exothermic reactions in the dissolver, which is well backmixed and is at a generally uniform temperature, raises the temperature of the reactants further to the range 800° to 900° F. (427° to 482° C.), preferably 840° to 870° F. (449° to 466° C.). The residence time in the dissolver zone is longer than in the preheater zone. The dissolver temperature is at least 20, 50, 100 or even 200° F. (11.1, 27.8, 55.5 or even 111.1° C.) higher than the outlet temperature of the preheater. The hydrogen pressure in the preheating and dissolver steps is in the range 1,000 to 4,000 psi, and is preferably 1,500 to 2,500 psi (70 to 280, and is preferably 105 to 175 kg/$cm^2$). The hydrogen is added to the slurry at one or more points. At least a portion of the hydrogen is added to the slurry prior to the inlet of the preheater. Additional hydrogen may be added between the preheater and dissolver and/or as quench hydrogen in the dissolver itself. Quench hydrogen is injected at various points when needed in the dissolver to maintain the reaction temperature at a level which avoids significant coking reactions.

Since the gasifier is preferably pressurized and is adapted to receive and process a slurry feed, the vacuum tower bottoms constitutes an ideal gasifier feed and should not be subjected to any hydrocarbon conversion or other process step which will disturb the slurry in advance of the gasifier. For example, the VTB should not be passed through either a delayed or a fluid coker in advance of the gasifier to produce coker distillate therefrom because the coke produced will then require slurrying in water to return it to acceptable condition for feeding to the gasifier. Gasifiers adapted to accept a solid feed require a lock hopper feeding mechanism and therefore are more complicated than gasifiers adapted to accept a slurry feed. The amount of water required to prepare an acceptable and pumpable slurry of coke is much greater than the amount of water that should be fed to the gasifier of this invention. The slurry feed to the gasifier of this invention is essentially water-free, although controlled amounts of water or steam are charged to the gasifier independently of the slurry feed to produce CO and $H_2$ by an endothermic reaction. This reaction consumes heat, whereas the reaction of carbonaceous feed with oxygen to produce CO generates heat. In a gasification process wherein $H_2$ is the preferred gasifier product, rather than CO, such as where a shift reaction, a methanation reaction, or a methanol conversion reaction will follow, the introduction of a large amount of water would be beneficial. However, in the process of this invention, where a considerable quantity of synthesis gas is utilized as process fuel, the production of hydrogen is of diminished benefit as compared to the production of CO, since $H_2$ and CO have about the same heat of combustion. Therefore, the gasifier of this invention can operate at the elevated temperatures indicated below in order to encourage nearly complete oxidation of carbonaceous feed even though these high temperatures induce a synthesis gas product with a mole ratio of $H_2$ to CO of less than one; preferably less than 0.8 or 0.9; and more preferably less than 0.6 or 0.7.

Because gasifiers are generally unable to oxidize all of the hydrocarbonaceous fuel supplies to them and some is unavoidably lost as coke in the removed slag, gasifiers tend to operate at a higher efficiency with a hydrocarbonaceous feed in the liquid state than with a solid carbonaceous feed, such as coke. Since coke is a solid degraded hydrocarbon, it cannot be gasified at as near to a 100 percent efficiency as a liquid hydrocarbonaceous feed so that more is lost in the molten slag formed in the gasifier than in the case of a liquid gasifier feed, which would constitute an unnecessary loss of carbonaceous material from the system. Whatever the gasifier feed, enhanced oxidation thereof is favored with increasing gasifier temperatures. Therefore, high gasifier temperatures are required to achieve the high process thermal efficiency of this invention. The maximum gasifier temperatures of this invention are in the range 2,200° to 3,600° F. (1,204° to 1,982° C.), generally; 2,300° to 3,200° F. (1,260° to 1,760° C.), preferably; and 2,400 or 2,500° to 3,200° F. (1,316 or 1,371° to 1,760° C.), most preferably. At these temperatures, all of the mineral residue derived from the feed coal is converted to molten slag, which is removed from the bottom of the gasifier.

The liquefaction process produces a significant quantity of both liquid fuels and hydrocarbon gases. Overall process thermal efficiency is enhanced by employing process conditions adapted to produce significant quantities of both hydrocarbon gases and liquid fuels, as compared to process conditions adapted to force the production of either hydrocarbon gases or liquids, exclusively. For example, the liquefaction zone should produce at least 8 or 10 weight percent of $C_1$ to $C_4$ gaseous fuels, and at least 15 to 20 weight percent of 380° to 850° F. (193° to 454° C.) distillate liquid fuel, based on feed coal. A mixture of methane and ethane is recovered and sold as pipeline gas. A mixture of propane and butane is recovered and sold as LPG. Both of these products are premium fuels. Fuel oil boiling in the range 380° to 850° F. (193° to 454° C.) recovered from the process is a premium boiler fuel. It is essentially free of mineral matter and contains less than about 0.4 or 0.5 weight percent of sulfur. The $C_5$ to 380° F. (193° C.) naphtha product generally comprises between about 4 and 20 weight percent of the feed coal, but more specifically comprises between about 5 and 15 weight percent of the feed coal. This amount of naphtha is produced directly under the conditions of the liquefaction zone and there is no independent cracking step outside of the liquefaction zone. Hydrogen sulfide is recovered from process effluentin an acid gas removal system and is converted to elemental sulfur.

As indicated above, curve A of FIG. 1 illustrates the thermal efficiency of an integrated coal liquefaction-gasification process wherein the product naphtha is sold in the form it is produced and is neither burned, hydrotreated nor reformed within the integrated process. The integrated coal liquefaction-gasification process of curve A of FIG. 1 is performed with a Kentucky bituminous coal using dissolver temperatures between 800° and 860° F. (427° and 460° C.) and a dissolver hydrogen pressure of 1700 psi (119 kg/cm$^2$). The dissolver temperature is higher than the maximum preheater temperature. The liquefaction zone is supplied with raw coal at a fixed rate and mineral residue is recycled in slurry with distillate liquid solvent and normally solid dissolved coal at a rate which is generally fixed to maintain the total solids content of the feed slurry at about 48 weight percent, which is close to a constraint solids level for pumpability, which is about 50 to 55 weight percent.

FIG. 1 relates the thermal efficiency of the combination process to the yield of 850° F.+(454° C.+) normally solid dissolved coal together with mineral residue, which contains undissolved organic matter, and which comprises the vacuum tower bottoms obtained from the liquefaction zone. This vacuum tower bottoms is the only carbonaceous feed to the gasification zone and is passed directly to the gasification zone without any intervening treatment. The amount of normally solid dissolved coal in the vacuum tower bottoms can be varied by changing the temperature, hydrogen pressure or residence time in the dissolver zone or by varying the ratio of feed coal to recycle mineral residue. Curve A of FIG. 1 is the thermal efficiency curve for the combination liquefaction-gasification process; curve B is the thermal efficiency for a typical gasification process including a shift reactor alone; and point C represents the general region of maximum thermal efficiency of the combination process.

The gasification system of curve B includes an oxidation zone to produce synthesis gas, a shift reactor and acid gas removal unit combination to convert a portion of the synthesis gas to a hydrogen-rich stream, a separate acid gas removal unit to purify another portion of the synthesis gas for use as a fuel, and a shift reactor and methanizer combination to convert any remaining synthesis gas to pipeline gas. Thermal efficiencies for gasification systems including an oxidation zone, a shift reactor and a methanizer combination commonly range between 50 and 65 percent, and are lower than thermal efficiencies for liquefaction processes having moderate yields of normally solid dissolved coal. The oxidizer in a gasification system produces synthesis gas as a first step. As indicated above, since synthesis gas contains carbon monoxide it is not a marketable fuel and requires a hydrogenative conversion such as a methanation step or a methanol conversion for upgrading to a marketable fuel. Carbon monoxide is not only toxic, but it has a low heating value so that transportation costs for synthesis gas are unacceptable on a heating value basis. The present process can utilize all, or at least 60 percent of the combustion heating value of the $H_2$ plus CO content of the synthesis gas produced beyond the amount required for hydrogen production as fuel within the plant, without hydrogenative conversion. The ability of the process to utilize syngas as process fuel contributes to an elevated thermal efficiency.

In order for the synthesis gas to be utilized as a fuel within the plant in accordance with this invention conduit means must be provided to transport the synthesis gas or a non-aliquot portion of the CO content thereof, following acid gas removal, to a combustion zone within the process and the combination zone must be equipped with combustion means adapted to burn the synthesis gas or a carbon monoxide-rich portion thereof as fuel without an intervening synthesis gas hydrogenation unit.

FIG. 1 shows that the thermal efficiency of the combination process is so low at 850° F.+ (454° C.+) dissolved coal yields greater than 45 percent that there is no efficiency advantage relative to gasification alone in operating a combination process at such high yields of normally solid dissolved coal. As indicated in FIG. 1, the absence of recycle mineral residue to catalyze the liquefaction reaction in a liquefaction process can induce a yield of 850° F.+ (454° C.+) dissolved coal as high as about 60 percent, based on feed coal. FIG. 1 indicates that the recycle of mineral residue the yield of 850° F.+ (454° C.+) dissolved coal is reduced to the region of 20 to 25 percent, which corresponds to the region of maximum thermal efficiency for the combination process. With recycle of mineral residue a fine adjustment in the yield of 850° F.+ (454° C.+) dissolved coal in order to optimize thermal efficiency can be accomplished by varying the temperature, hydrogen pressure, residence time and/or the ratio of recycle slurry to feed coal while maintaining a constant solids level in the feed slurry.

Point $D_1$ on curve A indicates the point of chemical hydrogen balance for the combination process. At an 850° F.+ (454° C.+) dissolved coal yield of 15 percent (point $D_1$), the gasifier produces the exact chemical hydrogen requirement of the liquefaction process. The thermal efficiency at the 850° F.+ (454° C.+) dissolved coal yield of point $D_1$ is the same as the efficiency at the larger 850° F.+ (454° C.+) dissolved coal yield of point $D_2$. When operating the process in the region of the lower yield of point $D_1$, the dissolver zone will be relatively large to accomplish the requisite degree of hydrocracking and the gasifier zone will be relatively small because of the relatively small amount of carbonaceous material which is fed to it. When operating the process in the region of point $D_2$, the dissolver zone will be relatively small because of the reduced amount of hydrocracking required at point $D_2$, but the gasifier zone will be relatively large. In the region between points $D_1$ and $D_2$ the dissolver zone and the gasifier zone will be relatively balanced and the thermal efficiency will be near a maximum.

Point $E_1$ on curve A indicates the point of process hydrogen balance, which includes hydrogen losses in the process. Point $E_1$ indicates the amount of 850° F.+ (454° C.+) dissolved coal that must be produced and passed to the gasifier zone to produce sufficient gaseous hydrogen to satisfy the chemical hydrogen requirement of the process plus losses of gaseous hydrogen in product liquid and gaseous streams. The relatively large amount of 850° F.+ (454° C.+) dissolved coal produced at point $E_2$ will achieve the same thermal efficiency as is achieved at point $E_1$. At the conditions of point $E_1$, the size of the dissolver will be relatively large to accomplish the greater degree of hydrocracking required at that point, and the size of the gasifier will be correspondingly relatively small. On the other hand, at the conditions of point $E_2$ the size of the dissolver will be relatively small because of the lower degree of hydrocracking, while the size of the gasifier will be relatively large. The dissolver and gasifier zones will be relatively balanced in size midway between points $E_1$ and $E_2$ (i.e. midway between 850° F.+ (454° C.+) coal yields of about 17.5 and 27 weight percent), and thermal efficiencies are the highest in this intermediate zone.

At point X on line $E_1E_2$, the yield of 850° F.+ (454° C.+) dissolved coal will be just adequate to supply all process hydrogen requirements and all process fuel requirements. At 850° F.+ (454° C.+) dissolved coal yields between points $E_1$ and X, all synthesis gas not required for process hydrogen is utilized as fuel within the process so that no hydrogenative conversion of synthesis gas is required and the thermal efficiency is high. However, at 850° F.+ (454° C.+) dissolved coal yields in the region between points X and $E_2$, the 850° F.+ (454° C.+) dissolved coal produced in excess of point X cannot be consumed within the process and therefore will require further conversion, such as methanation for sale as pipeline gas.

FIG. 1 shows that the thermal efficiency of an integrated coal liquefaction-gasification process in which product naphtha is removed from the process without any upgrading step increases as the amount of synthesis gas available for fuel increases and reaches a peak in the region of point Y, where the synthesis gas produced just supplies the entire process fuel requirement. The efficiency starts to decline at point Y because more synthesis gas is produced than the process can utilize as plant fuel and because it is at point Y that a methanation unit is required to convert the excess synthesis gas to pipeline gas. FIG. 1 shows that the improved thermal efficiencies are achieved when the amount of 850° F.+ (454° C.+) dissolved coal produced is adequate to produce any amount, for example, from about 5, 10 or 20 up to about 90 or 100 percent of process fuel requirements. FIG. 1 indicates that the thermal efficiency advantage still prevails, albeit to a diminished extent, when most of the synthesis gas produced is utilized without methanation to supply process fuel requirements, although a limited excess amount of synthesis gas is produced which requires methanation to render it marketable. When the amount of synthesis gas produced which requires methanation becomes excessive, as indicated at point Z, the efficiency advantage of the combination process is lost. It is significant to note that a one percent efficiency increase in a commercial size plant of the type illustrated in FIG. 1 can effect an annual savings of about ten million dollars.

FIG. 1 shows that high thermal efficiencies are associated with moderate yields of normally solid dissolved coal which, in turn, are associated with moderate liquefaction conditions. At moderate conditions, significant yields of hydrocarbon gases, naphtha and liquid fuels boiling above the naphtha range are produced in the liquefaction zone and very high and very low yields of normally solid dissolved coal are discouraged. As indicated, the moderate conditions which result in the production of a relatively balanced mix of hydrocarbon gases, naphtha and other liquids and solid coal in the liquefaction zone require a plant wherein the sizes of the dissolver and gasifier zones are reasonably balanced, with both zones being of intermediate size. When the sizes of the dissolver and gasifier zones are reasonably balanced the gasifier will produce more synthesis gas than is required for process hydrogen requirements. Therefore, a balanced process requires a plant in which means are provided for passage of a stream of synthesis gas after acid gas removal to the liquefaction zone or elsewhere in the process at one or more sites therein which are provided with burner means for combustion of said synthesis gas or a carbon monoxide-rich portion thereof as plant fuel. In general, a different type of burner will be required for the combustion of synthesis gas or carbon monoxide than is required for the combustion of hydrocarbon gases. It is only in such a plant that optimal thermal efficiency can be achieved. Therefore, such a plant feature is critical if a plant is to embody the thermal efficiency optimization discovery of this invention.

Mineral residue produced in the process constitutes a hydrogenation and hydrocaracking catalyst and recycle thereof within the process to increase it concentration results is an increase in the rates of reactions which naturally tend to occur, thereby reducing the required residence time in the dissolver and/or reducing the required size of the dissolver zone. The mineral residue is suspended in product slurry in the form of very small particles 1 to 20 microns in size, and the small size of the particles probably enhances their catalytic activity. The recycle of catalytic material sharply reduces the amount of solvent required. Therefore, recycle of process mineral residue in slurry with distillate liquid solvent in an amount adequate to provide a suitable equilibrium catalytic activity tends to enhance the thermal efficiency of the process.

The catalytic and other effects due to the recycle of process mineral residue can reduce by about one-half or even more the normally solid dissolved coal yield in the liquefaction zone via hydrocracking reactions, as well as inducing an increased removal of sulfur and oxygen. As indicated in FIG. 1, a 20 to 25 percent 850° F.+ (454° C.+) coal yield provides essentially a maximum thermal efficiency in the combination liquefaction-gasification process illustrated. A similar degree of hydrocracking cannot be achieved satisfactorily by allowing the dissolver temperature to increase without restraint via the exothermic reactions occurring therein because excessive coking would result.

Use of an external catalyst in the liquefaction process is not equivalent to recycle of mineral residue because introduction of an external catalyst would increase process cost, make the process more complex and thereby reduce process efficiency as contrasted to the use of an indiginous or in situ catalyst. Therefore, the present process does not require or employ an external catalyst.

As already indicated, the thermal efficiency optimization curve of FIG. 1 relates thermal efficiency optimization to the yield of normally solid dissolved coal specifically and requires that all the normally solid dissolved coal obtained, without any liquid coal or hydrocarbon gases, be passed to the gasifier. Therefore, it is critical that any plant which embodies the described efficiency optimization curve employ a vacuum distillation tower, preferably in association with an atmospheric tower, to accomplish a complete separation of normally solid dissolved coal from liquid coal and hydrocarbon gases. An atmospheric tower alone is incapable of complete removal of distillate liquid from normally solid dissolved coal. If liquid coal is passed to the gasifier a reduced efficiency will result since, unlike normally solid dissolved coal, liquid coal is a premium fuel. Liquid coal consumes more hydrogen in its production than does normally solid dissolved coal. The incremental hydrogen contained in liquid coal would be wasted in the oxidation zone, and this waste would constitute a reduction in process efficiency.

As indicated above, the liquefaction zone produces a variety of products, including raw naphtha, and in the process illustrated in FIG. 1 all of the raw naphtha produced is removed without upgrading for sale as a product of the process. However, raw naphtha is not a highly marketable commodity because it is volatile and therefore can be dangerous to store. It is therefore desirable to integrate a reforming zone into the liquefaction-gasification zone combination for upgrading naphtha produced in the process to high octane gasoline.

In the process of the present invention a naphtha reforming zone is integrated into a combined coal liquefaction-gasification process as described above. The raw naphtha fraction produced in the liquefaction operation generally comprises about 4 to 20 weight percent of the feed coal on a dry basis, and more specifically comprises about 5 to 15 weight percent of the dry feed coal. The raw naphtha will generally comprise a $C_5$ to 380° F. (193° C.) fraction but can comprise any fraction in the range $C_5$ to 350° F. (177° C.) to $C_5$ to 450° F. (233° C.). If some or even all of the raw naphtha is employed as process fuel, the amount of naphtha produced will always be inadequate to supply the entire process fuel requirement, especially since an increasing naphtha yield requires an increasing process severity and an increasing energy consumption.

Raw naphtha produced in the liquefaction zone is passed to a reforming zone wherein the raw naphtha is converted to high octane gasoline with a small quantity of by-product $C_1$ to $C_4$ gases. The reforming zone comprises in series a first preheater, a catalytic hydropretreater, a second preheater and a catalytic reformer. The hydropretreater contains a Group VI-Group VIII metal catalyst, such as cobalt-molybdenum or nickel-cobalt-molybdenum, on a non-cracking support, such as alumina. The naphtha is desulfurized and denitrogenized in the hydropretreating zone. Process conditions in the hydropretreating zone include a temperature in the range 600° to 850° F. (316° to 454° C.) and a hydrogen pressure in the range 500 to 2,000 psi (35 to 140 kg/cm$^2$).

The reformer contains a noble metal catalyt, such as platinum or palladium, on a non-cracking support, such as alumina. Process conditions in the reformer include a temperature in the range 800° to 975° F. (427° to 524° C.) and a hydrogen pressure in the range 100 to 800 psi (7 to 56 kg/cm$^2$). Although the hydropretreater consumes hydrogen for the performance of desulfurization and denitrogenation reactions, the reformer performs dehydrogenation and dehydrocyclization reactions which produce a greater quantity of hydrogen than is consumed in the hydropreptreater so that there is a net production of hydrogen in the combined reforming zone. However, the two preheating furnaces in the reforming zone consume heat energy and the amount of heat energy consumed in the combined reforming zone exceeds the heat energy contained in the net hydrogen yield of the reforming zone. Therefore, the thermal efficiency of the integrated coal liquefaction-gasification-reforming operation will be lower than the thermal efficiency of the integrated coal liquefaction-gasification operation of FIG. 1 wherein the naphtha product is not upgraded. Of course, the loss in thermal efficiency is compensated by the enhanced economic value of the gasoline produced compared to the value of raw naphtha. It is an objective of the present invention to integrate the reforming zone into the coal liquefaction-gasification operation in a manner providing high process flexibility and/or a minimal reduction in thermal efficiency.

Figure 2:
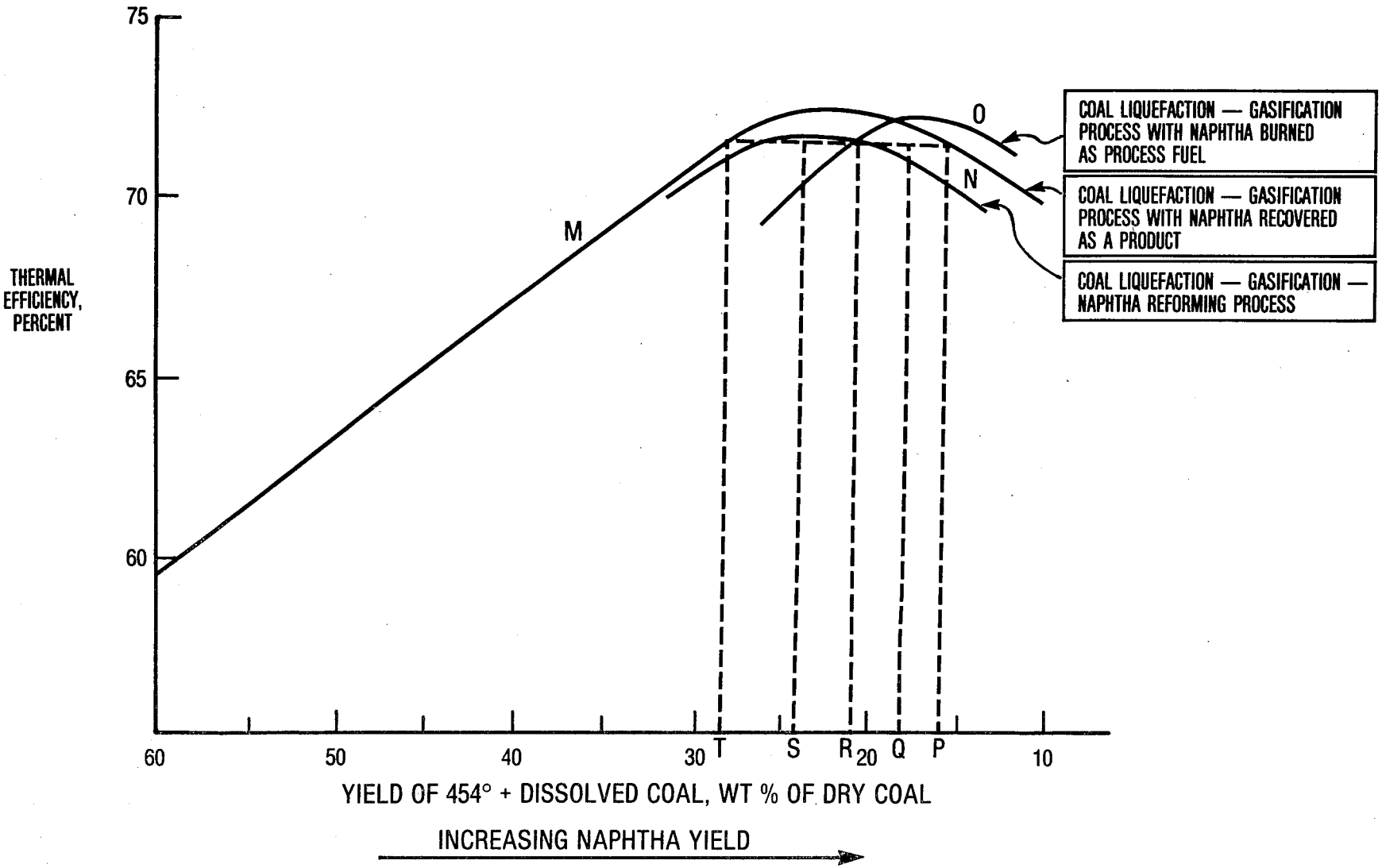
FIG. 2 is a graph of the percent of thermal efficiency verses the yield of 454° C. plus dissolved coal, wt. % of dry coal. This graph discloses the manner of handling of the naphtha products.

The present invention is illustrated by thermal efficiency curves M, N and O of FIG. 2. The processes illustrated in these three curves differ from each other in respect to the manner of handling the naphtha product. Curve M of FIG. 2 represents the same process as was illustrated in FIG. 1, which includes integrated coal liquefaction and gasification zones wherein the naphtha produced is removed from the process. Curve O shows the thermal efficiency for a process similar to that of curve M except that the entire naphtha fraction produced in the liquefaction zone is burned as fuel within the process. Curve N shows the thermal efficiency for a similar coal liquefaction-gasification process into which a naphtha reformer zone is integrated. The naphtha reforming zone comprises naphtha hydrotreating and reforming steps for upgrading the entire naphtha fraction produced in the liquefaction zone to gasoline. In the processes of curves O and N the gasifier supplies syngas fuel for the reformer to the extent that syngas fuel is available and required, while hydrogen generated in the reformer is employed as a reactant in the liquefaction zone. In the process of curve N, the use of syngas fuel in the reformer zone and the use within the process of hydrogen generated in the reformer zone are interdependent process features because the generation of hydrogen within the reformer zone which is accomplished via the energy supplied by the syngas permits enhanced usage of syngas as fuel without requiring the syngas itself to undergo an energy consuming shift reaction for conversion to hydrogen. Therefore, the use of syngas as fuel in the reforming zone coupled with the recovery of hydrogen from the reforming zone is more efficient than the direct upgrading of syngas to hydrogen.

Observing curve M, at the relatively low normally solid dissolved coal yield P, the gasifier produces precisely the amount of hydrogen required to satisfy the hydrogen requirement of the liquefaction zone. At yields of normally solid dissolved coal lower than that indicated by point P the gasifier is unable to satisfy process hydrogen requirements so that process efficiency declines since valuable product hydrocarbon gases must be steam reformed to make up the deficit in process hydrogen. As the yield of normally solid dissolved coal increases above that corresponding to point P, the gasifier progressively becomes more capable of producing not only the entire process hydrogen requirement but also extraneous syngas for use as process fuel, thereby supplanting more valuable product hydrocarbon gases as process fuel. At normally solid dissolved coal yield S the gasifier produces the total hydrogen and syngas fuel requirements, so that process efficiency is at a maximum. At a higher normally solid dissolved coal yield T, the syngas yield is so high that a portion of the syngas product must be hydrogenated for conversion to pipeline gas which, unlike syngas, is a marketable fuel, but whose production induces a decline in process efficiency.

In regard to curve O, at normally solid dissolved coal yield P and lower, process efficiency is relatively low because the gasifier is unable to produce an amount of hydrogen adequate to satisfy process requirements, so that valuable hydrocarbon gases produced in the process must be steam reformed to make up the deficit in process hydrogen requirements. At normally solid dissolved coal yield Q, the gasifier is able to produce sufficient hydrogen to supply the entire process hydrogen requirement so that the efficiency of the process is at a maximum. At higher normally solid dissolved coal yield R, process efficiency is declining because more syngas is produced than can be consumed as process fuel because of the availability of naphtha as fuel, requiring the excess syngas to be methanated and converted to pipeline gas to be rendered marketable. It is less efficient to hydrogenatively upgrade syngas to pipeline gas than it is to burn it as process fuel.

Curve N generally corresponds to curve M except that the indicated thermal efficiency is lower because the naphtha reforming step consumes heat energy without significantly changing the heating value of the product and without producing sufficient net hydrogen to offset the increased heat energy requirement. The efficiency differential between curves M and N is the greatest at relatively low yields of normally solid dissolved coal for the reason that the increased process fuel requirement induced by the naphtha reforming step cannot be satisfied by the relatively small quantity of syngas fuel produced. However, the efficiency differential between the two curves diminishes asymptotically as the yield of normally solid dissolved coal increases because increasing amounts of syngas are becoming available for use as process fuel and the process of curve N is able to utilize more syngas as fuel than the process of curve M because of the superadded energy requirement of the reformer zone. The reason that the differential between curves M and N does not disappear at high yields of normally solid dissolved coal, even above point T, is that increasing yields of normally solid dissolved coal and corresponding increases in the yield of syngas fuel are accompanied by decreases in the amount of naphtha produced and available for reforming.

FIG. 2 shows that curves O and N intersect at a normally solid dissolved coal yield R. At the point of intersection of curves O and N changes in the ratio of the portion of naphtha allocated to process fuel (curve O) and to reformer feed (curve N) have no effect upon process efficiency. Therefore, the point of intersection of curves O and N represents an efficiency indifference point wherein an integrated coal liquefaction-gasification process employing product naphtha as process fuel can be converted at no change in thermal efficiency to an integrated coal liquefaction-gasification-reformer process employing a portion or all the naphtha as reformer feed.

When an integrated coal liquefaction-gasification-reformer process is controlled to produce normally solid dissolved coal yield R, regardless of minor variations in the yield of normally solid dissolved coal, i.e. less than about 1 or 2 percentage points above or below percentage yield R, naphtha can be employed as process fuel without incurring any significant penalty. Thereupon, changes in the ratio of the naphtha streams allocated to process fuel and reformer feedstocks can be made in a manner to compensate for either increases or decreases in the normally solid dissolved coal yield about point R. The ratio of the naphtha streams can be adjusted so that the thermal efficiency will not decline more than one or two percentage points below the indifference efficiency percentage upon changes in the yield of normally solid dissolved coal. In general, FIG. 2 shows that an increase in the yield of normally solid dissolved coal above point R should be accompanied by a relative increase in the proportion of the total naphtha employed as a reformer feedstock, or should be accompanied by all of the naphtha being temporarily diverted to use as a reformer feedstock, in order to preferentially follow curve N rather than curve O, and thereby induce an increase in process efficiency in the region of normally solid dissolved coal yields higher than point R. FIG. 2 further shows that a decrease in the yield of normally solid dissolved coal to a level below point R should be accompanied by an increase in the proportion of the total naphtha which is employed as process fuel, or should be accompanied by all of the naphtha being temporarily diverted to use as process fuel, in order to preferentially follow curve O rather than curve N in this region, and thereby induce an increase in process efficiency. It is seen that in an integrated coal liquefaction-gasification-reforming process the total naphtha product can be apportioned to process fuel and/or to a reformer feedstock without a substantial effect upon process efficiency. Therefore, increases and decreases in the yield of normally solid dissolved coal can be accompanied by a change in the ratio of the total naphtha apportioned between process fuel and reformer feedstock in a manner to either maintain or to increase the efficiency of the process above the indifference efficiency, or at least to prevent a decrease in efficiency of more than one or two percentage points below the indifference efficiency.

Process control in this manner can prevent the sharp loss of efficiency that is otherwise likely to occur upon changes in the yield of normally solid dissolved coal to levels above or below the indifference efficiency. When allocating the naphtha within the process in this manner, generally between about 0 or 5 and 70 weight percent and more particularly between about 0 or 10 and 40 weight percent of the raw naphtha produced in the liquefaction zone will be employed as fuel in the integrated process. The remainder of the raw naphtha will constitute the feedstock for the reformer zone. Generally, between about 30 and 95 or 100 weight percent and more particularly between about 60 and 90 or 100 weight percent of the raw naphtha produced in the liquefaction zone will constitute the feedstock for the reformer zone.

An integrated coal liquefaction-gasification-reforming process has the advantage of a high degree of flexibility when the yield of normally solid coal corresponds substantially to the indifference efficiency. However, FIG. 2 shows that in the integrated liquefaction-gasification-reformer process of curve N, increases in the yield of normally solid dissolved coal above point R are accompanied by a gradually increasing efficiency. The reason is that as the yield of normally solid dissolved coal increases to a level enabling the gasifier to produce sufficient syngas to supply the entire fuel requirements for both the liquefaction zone and the reformer zone while the total naphtha product is employed as reformer feed, an enhanced efficiency effect based upon syngas production is achieved. Any increase in the production of syngas and its direct use as process fuel, which does not entail hydrogenative upgrading of the syngas, induces an increase in process efficiency. When all of the naphtha product is employed as reformer feedstock and essentially none as process fuel, and when the gasifier produces sufficient syngas to supply most or essentially all of the fuel requirements of both the liquefaction and reformer zones, the increased usage of syngas as process fuel induces an asymptotic approach of curve N towards curve M. As stated above, the reason that curve N does not ultimately meet curve M is that as the yield of normally solid dissolved coal and syngas produced therefrom increases the corresponding yield of naphtha decreases, which diminishes the syngas fuel requirement in the reforming step.

At the indifference efficiency, the portions of the total naphtha employed as a reformer feedstock and as process fuel can be varied in any ratio without affecting process efficiency. Under such divided naphtha usage, some of the valuable naphtha product usually must serve as a fuel within the process because syngas production will tend to be insufficient to supply the total fuel requirement. Therefore, at the indifference efficiency the efficiency differential between curves M and N is relatively great. On the other hand, when the syngas output becomes sufficiently great with increasing yields of normally solid dissolved coal to supply the entire process fuel requirement, none of the valuable naphtha product is required for use as process fuel and all of the naphtha can be employed as reformer feedstock. This situation corresponds to the concurrence of a high availability of syngas for use as process fuel and a high requirement for syngas fuel, since the reformer is operating under a full naphtha feed load. Under these conditions, the efficiency differential between curves M and N becomes relatively small.

FIG. 2 shows that there is no difference in process efficiency for the process of curve M at relatively high and low yields of normally solid dissolved coal T and P. However, FIG. 2 shows that at relatively low normally solid dissolved coal yield P, an efficiency improvement can be achieved by employing product naphtha as process fuel (curve O) becomes of the insufficient availability of syngas. FIG. 2 further shows that at relatively low normally solid dissolved coal yield P a relatively great reduction in process efficiency occurs if the entire naphtha product is utilized as reformer feedstock (curve N) because the addition of a reforming zone would increase the fuel load on the process while removing the naphtha fuel availability, while the syngas yield is inadequate to supply process fuel requirements.

FIG. 2 shows that a very different situation prevails at relatively high normally solid dissolved coal yield T. At normally solid dissolved coal yield T, there is adequate syngas to supply the entire fuel requirement for both the liquefaction zone and the reformer zone, enabling the total naphtha product to be utilized as a reformer feedstock, thereby enabling a greater use of syngas as fuel with the corresponding efficiency advantage thereof. At normally solid dissolved coal yield T there is a relatively small efficiency penalty entailed in integrating a reformer into a liquefier-gasifier combination because the amount of syngas produced or a CO fraction thereof may be adequate without hydrogenative upgrading to supply most or all of the total process energy requirement which includes the energy requirement of the reformer zone. It is noted that at normally solid dissolved coal yield T there would be a very great efficiency penalty if the naphtha product were utilized as process fuel (curve O), since this would diminish the requirement for syngas as process fuel and would require additional syngas to be hydrogenatively upgraded to pipeline gas, reducing process efficiency.

The efficiency penalty between curves M and N at relatively high normally solid dissolved coal yield T is only about one-third of the efficiency penalty at relatively low normally solid dissolved coal yield P. At relatively high normally solid dissolved coal yield T, the penalty in thermal efficiency incurred by integrating a reforming step into a coal liquefaction-gasification process can be no more than one or two percentage points, based on the thermal efficiency of a similar integrated process without a reforming step. It is remarkable process feature that at relatively high normally solid dissolved coal yield T, while a two-step process can be operated at a thermal efficiency of about 72 percent, a three-step process can operate at a thermal efficiency as high as about 71 percent, while a higher quality product is achieved. The low thermal efficiency penalty incurred by the addition of a reforming step at a relatively high normally solid dissolved coal yield shows that there is a high motivation for incorporating a reforming step when the normally solid dissolved coal yield is relatively high. The reason for the high motivation for adding a reforming step at a relatively high normally solid dissolved coal yield is that the added reforming process offers an opportunity for an advantageous consumption of the accompanying high yield of syngas fuel. The direct use of syngas as fuel within the process avoids the requirement for performing a shift reaction step on the syngas fuel, and the added reforming step cooperates in this effect by providing a net yield of hydrogen for the process that otherwise would have been provided with a lower efficiency by passing some of the syngas used as fuel through a shift reactor.

Figure 3:
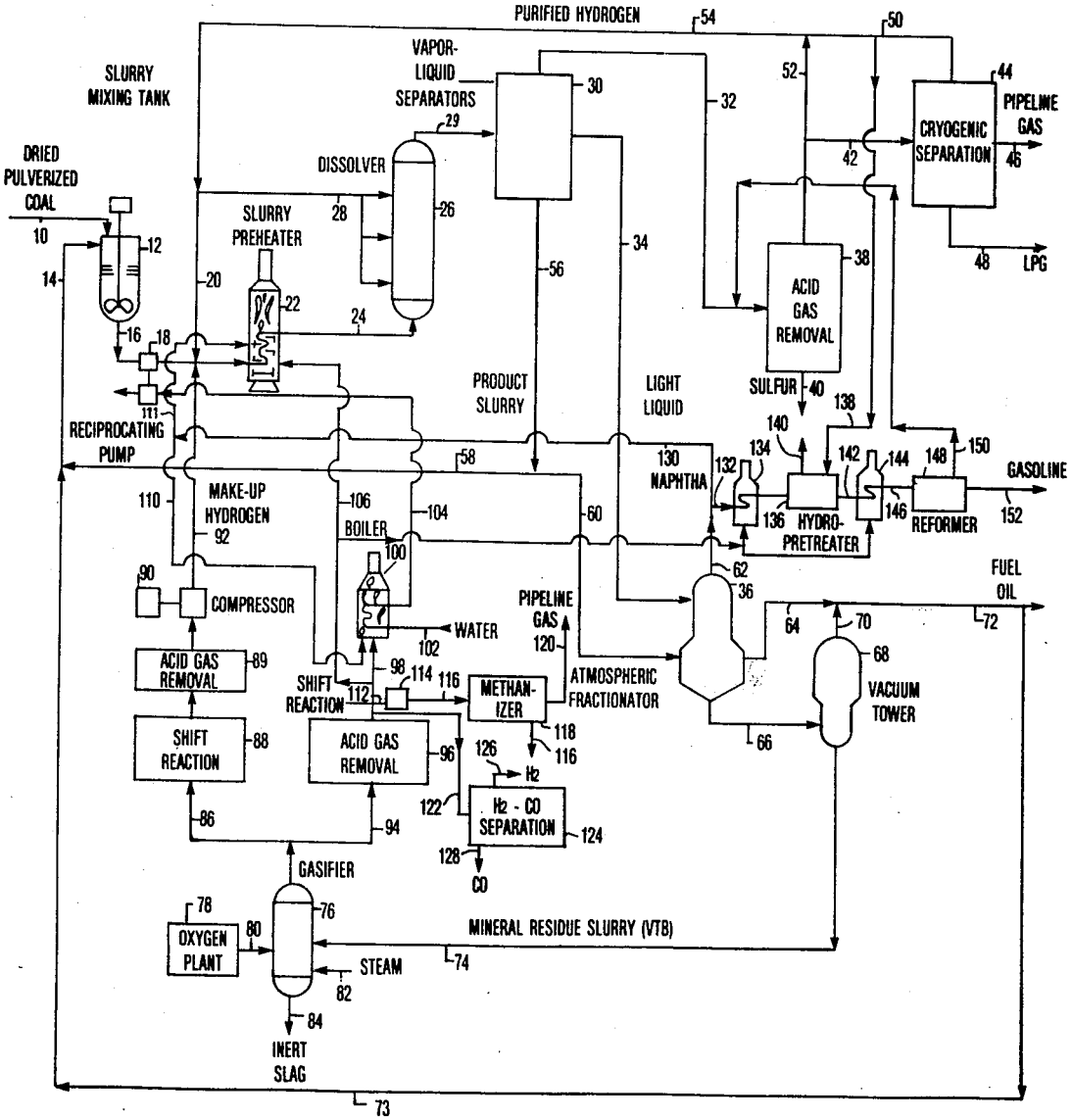
FIG. 3 is a flow diagram of the claimed process.

A scheme for performing the combination process of this invention is illustrated in FIG. 3. Dried and pulverized raw coal, which is the entire raw coal feed for the process, is passed through line 10 to slurry mixing tank 12 wherein it is mixed with hot solvent-containing recycle slurry from the process flowing in line 14. The solvent-containing recycle slurry mixture (in the range 1.5–2.5 parts by weight of slurry to one part of coal) in line 16 is pumped by means of reciprocating pump 18 and admixed with recycle hydrogen entering through line 20 and with make-up hydrogen entering through line 92 prior to passage through tubular preheater furnace 22 from which it is discharged through line 24 to dissolver 26. The ratio of hydrogen to feed coal is about 40,000 SCF/ton (1.24 $M^3$/kg).

The temperature of the reactants at the outlet of the preheater is about 700° to 760° F. (371° to 404° C.). At this temperature the coal is partially dissolved in the recycle solvent, and the exothermic hydrogenation and hydrocracking reactions are just beginning. Whereas the temperature gradually increases along the length of the preheater tube, the dissolver is at a generally uniform temperature throughout and the heat generated by the hydrocracking reactions in the dissolver raise the temperature of the reactants to the range 840°–870° F. (449°–466° C.). Hydrogen quench passing through line 28 is injected into the dissolver at various points to control the reaction temperature and alleviate the impact of the exothermic reactions.

The dissolver effluent passes through line 29 to vapor-liquid separator system 30. The hot overhead vapor stream from these separators is cooled in a series of heat exchanges and additional vapor-liquid separation steps and removed through line 32. The liquid distillate from these separators passes through line 34 to atmospheric fractionator 36. The non-condensed gas in line 32 comprises unreacted hydrogen, methane and other light hydrocarbons, plus $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen (90 percent pure) in line 50 is blended with the remaining gas from the acid gas treating step in line 52 and comprises the recycle hydrogen for the process.

The slurry from the vapor-liquid separator 30 passes through line 56 and is split into two major streams, 58 and 60. Stream 56 comprises the recycle slurry containing solvent, normally dissolved coal and catalytic mineral residue. The non-recycled portion of this slurry passes through line 60 to atmospheric fractionator 36 for separation of the major products of the process.

In fractionator 36 the slurry product is distilled at atmospheric pressure to remove an overhead naphtha stream through line 62, a middle distillate stream through line 64 and a bottoms stream through line 66. The bottoms stream in line 66 passes to vacuum distillation tower 68. A blend of the fuel oil from the atmospheric tower in line 64 and the middle distillate recovered from the vacuum tower through line 70 makes up the major fuel oil product of the process and is recovered through line 72. The stream in line 72 comprises 380°-850° F. (193°-454° C.) distillate fuel oil product and a portion thereof can be recycled to feed slurry mixing tank 12 through line 73 to regulate the solids concentration in the feed slurry and the coal-solvent ratio. Recycle stream 73 imparts flexibility to the process by allowing variability in the ratio of solvent to slurry which is recycled, so that this ratio is not fixed for the process by the ratio prevailing in line 58. It also can improve the pumpability of the slurry.

The bottoms from the vacuum tower, consisting of all the normally solid dissolved coal, undissolved organic matter and mineral matter, without any distillate liquid or hydrocarbon gases, is passed through line 74 to partial oxidation gasifier zone 76. Since gasifier 76 is adapted to receive and process a hydrocarbonaceous slurry feed stream, there should not be any hydrocarbon conversion step between vacuum tower 68 and gasifier 76, such as a coker, which will destroy the slurry and necessitate reslurrying in water. The amount of water required to slurry coke is greater than the amount of water ordinarily required by the gasifier so that the efficiency of the gasifier will be reduced by the amount of heat wasted in vaporizing the excess water. Nitrogen-free oxygen for gasifier 76 is prepared in oxygen plant 78 and passed to the gasifier through line 80. Steam is supplied to the gasifier through line 82. The entire mineral content of the feed coal supplied through line 10 is eliminated from the process as inert slag through line 84, which discharges from the bottom of gasifier 76. Synthesis gas is produced in gasifier 76 and a portion thereof passes through line 86 to shift reactor zone 88 for conversion by the shift reaction wherein steam and CO is converted to $H_2$ and $CO_2$, followed by an acid gas removal zone 89 for removal of $H_2S$ and $CO_2$. The purified hydrogen obtained (90 to 100 percent pure) is then compressed to process pressure by means of compressor 90 and fed through line 92 to supply make-up hydrogen for preheater zone 22 and dissolver 26. Heat generated within gasifier zone 76 is not considered to be a consumption of energy within the process, but merely heat of reaction required to produce a synthesis gas reaction product.

The amount of synthesis gas produced in gasifier 76 is sufficient not only to supply the molecular hydrogen required by the process other than that produced in the reforming zone, but also to supply syngas as process fuel. To this end, the portion of the synthesis gas that does not flow to the shift reactor passes through line 94 to acid gas removal unit 96 wherein $CO_2+H_2S$ are removed therefrom. The removal of $H_2S$ allows the synthesis gas to meet the environmental standards required of a fuel while the removal of $CO_2$ increases the heat content of the synthesis gas so that finer heat control can be achieved when it is utilized as a fuel. A stream of purified synthesis gas passes through line 98 to boiler 100. Boiler 100 is provided with means for combustion of the synthesis gas as a fuel. Water flows through line 102 to boiler 100 wherein it is converted to steam which flows through line 104 to supply process energy, such as to drive reciprocating pump 18. A separate stream of synthesis gas from acid gas removal unit 96 is passed through line 106 to preheater 22 for use as a fuel therein. The synthesis gas can be similarly used at any other point of the process requiring fuel. If the synthesis gas does not supply all of the fuel required for the process, some of the energy for the process can be derived from a source outside of the process, not shown, such as from electric power.

Additional synthesis gas can be passed through line 112 to shift reactor 114 to increase the ratio of hydrogen to carbon monoxide from 0.6 to 3. This enriched hydrogen mixture is then passed through line 116 to methanation unit 118 for conversion to pipeline gas, which is passed through line 120 for mixing with the pipeline gas in line 46. The amount of pipeline gas based on heating value passing through line 120 will be less than the amount of synthesis gas used as process fuel passing through lines 98 and 106 to insure the thermal efficiency advantage of this invention.

A portion of the purified synthesis gas stream is passed through line 122 to a cryogenic separation unit 124 wherein hydrogen and carbon monoxide are separated from each other. An adsorption unit can be used in place of the cryogenic unit. A hydrogen-rich stream is recovered through line 126 and can be blended with the make-up hydrogen stream in line 92, independently passed to the liquefaction zone or sold as a product of the process. A carbon monoxide-rich stream is recovered through line 128 and can be blended with synthesis gas employed as process fuel in line 98 or in line 106, or can be sold or used independently as process fuel or as a chemical feedstock.

Some of the raw naphtha product in line 62 can be used as process fuel by passage through line 130 to line 110 and boiler 100 and/or by passage through line 111 to slurry preheater 22. The remainder or all of the naphtha in line 62 can be passed through line 132 and furnace 134 for preheating prior to passage through hydropretreater 136. Hydropretreater 136 receives hydrogen through line 138 and catalytically removes sulfur and nitrogen from the raw naphtha. A sulfur- and ammonia-contaiminated hydrogen stream is discharged from the hydropreheater through line 140. The catalyst in hydropretreater 136 comprises Group VI and Group VIII metals on a non-cracking support. A suitable catalyst comprises cobalt-molybdenum or nickel-cobalt-molybdenum or alumina.

A stream of desulfurized and denitrogenized naphtha from hydropretreater 136 passes through line 142 to furnace 144 from which a preheated and a hydrotreated naphtha stream is discharged through line 146 to reformer 148. Reformer 148 contains a catalyst comprising a noble metal such as platinum or palladium on a non-cracking support such as alumina. The dehydrogenation and dehydrocyclization reactions occurring in reformer 148 yield a stream containing hydrogen and $C_1$ to $C_4$ gases which passes through line 150 to line 32 for ultimate separation of hydrogen from hydrocarbon gases. High octane gasoline product is recovered through line 152.

I claim:

1. A combination coal liquefaction-gasification-naphtha reforming process comprising passing substantially the entire raw mineral-containing feed coal for the process, hydrogen, recycle dissolved liquid solvent, recycle normally solid dissolved coal and recycle mineral residue to a coal liquefaction zone to dissolve hydrocarbonaceous material from mineral residue and to hydrocrack said hydrocarbonaceous material to produce a mixture comprising hydrocarbon gases, naphtha, dissolved liquid boiling above the naphtha boiling range, normally solid dissolved coal and suspended mineral residue; recycling to said liquefaction zone a portion of said dissolved liquid boiling above the naphtha boiling range, normally solid dissolved coal and mineral residue; separating a naphtha fraction; separating distillate liquid boiling above the naphtha range from non-recycled normally solid dissolved coal and mineral residue to produce a gasifier feed slurry; passing a first portion of the total naphtha yield of said process comprising between about 30 and 95 weight percent of the total through a reforming zone comprising heating means, a naphtha hydropretreater and a reformer for conversion to gasoline; said reforming zone producing a first hydrogen-rich stream; returning said first hydrogen-rich stream to said process for use as process hydrogen; passing a second portion of the total naphtha yield comprising between about 5 to 70 weight percent of the total of said process as fuel and burning said second portion of naphtha in said process; said gasifier feed slurry comprising substantially the entire normally solid dissolved coal and mineral residue yield of said liquefaction zone substantially without normally liquid coal and hydrocarbon gases; passing said gasifier feed slurry to a gasification zone; said gasifier feed slurry comprising substantially the entire hydrocarbonaceous feed to said gasification zone; said gasification zone including an oxidation zone for the conversion of hydrocarbonaceous material to synthesis gas; converting a portion of said synthesis gas to a second hydrogen-rich stream; returning said second hydrogen-rich stream to said process for use as process hydrogen; the amount of hydrocarbonaceous material passed to said gasification zone being sufficient to enable said gasification zone to produce an additional amount of synthesis gas beyond the amount required to produce process hydrogen; burning said additional amount of synthesis gas or a CO fraction thereof without hydrogenative upgrading as fuel in said process; and the amount of hydrocarbonaceous material passed to said gasification zone being established so that the thermal efficiency of said process is substantially unaffected by changes in the ratio of said first portion of naphtha to said second portion of naphtha.

2. The process of claim 1 wherein changes in the amount of hydrocarbonaceous material passed to said gasification zone tends to reduce the thermal efficiency of said process; and changing the ratio of said first portion of naphtha to said second portion of naphtha upon changes in the amount of hydrocarbonaceous material passed to the gasification zone to inhibit or avoid a thermal efficiency loss.

3. The process of claim 1 wherein said first portion of naphtha comprises between about 60 and 90 weight percent of the total naphtha and said second portion comprises between about 10 and 40 weight percent of the total naphtha.

4. The process of claim 1 wherein the total combustion heat content of said additional amount of synthesis gas or said CO fraction thereof is at least 5 percent on a heat basis of the total energy requirement of said process.

5. The process of claim 1 wherein the total combustion heat content of said additional amount of synthesis gas or said CO fraction thereof is at least 50 percent on a heat basis of the total energy requirement of said process.

6. The process of claim 1 wherein an increase in the amount of hydrocarbonaceous material passed to said gasification zone is accompanied by an increase in the ratio of said first portion of naphtha to said second portion of naphtha.

7. The process of claim 1 wherein a decrease in the amount of hydrocarbonaceous material passed to said gasification zone is accompanied by a decrease in the ratio of said first portion of naphtha to said second portion of naphtha.

8. The process of claim 1 wherein a decrease in the amount of hydrocarbonaceous material passed to said gasification zone is accompanied by a temporary diversion of the entire naphtha yield of said process to said process as fuel.

9. The process of claim 2 wherein the thermal efficiency of said process remains substantially unchanged upon changes in the ratio of said first portion of naphtha to said second portion of naphtha.

10. The process of claim 2 wherein the thermal efficiency of said process is increased upon changes in the ratio of said first portion of naphtha to said second portion of naphtha.

11. The process of claim 2 wherein the thermal efficiency of said process declines less than two percentage points upon changes in the ratio of said first portion of naphtha to said second portion of naphtha.

12. The process of claim 2 wherein the thermal efficiency of said process declines less than one percentage point upon changes in the ratio of said first portion of naphtha to said second portion of naphtha.

* * * * *